US009366072B1

(12) United States Patent
Orozco Aguayo

(10) Patent No.: US 9,366,072 B1
(45) Date of Patent: Jun. 14, 2016

(54) ADJUSTABLE SCREEN FRAME ASSEMBLY

(71) Applicant: Jose Humberto Orozco Aguayo, Santa Isabel Iztapalapa (MX)

(72) Inventor: Jose Humberto Orozco Aguayo, Santa Isabel Iztapalapa (MX)

( * ) Notice: Subject to any disclaimer, the term of this patent is extended or adjusted under 35 U.S.C. 154(b) by 0 days.

(21) Appl. No.: 14/628,835

(22) Filed: Feb. 23, 2015

(51) Int. Cl.
*E06B 3/96* (2006.01)
*E06B 3/968* (2006.01)
*E06B 3/964* (2006.01)

(52) U.S. Cl.
CPC . *E06B 3/96* (2013.01); *E06B 3/964* (2013.01); *E06B 3/968* (2013.01); *E06B 3/9687* (2013.01)

(58) Field of Classification Search
CPC ... E06B 3/9681; E06B 3/9682; E06B 3/9684; E06B 3/9685; E06B 3/9687; E06B 3/9688; E06B 3/9608; E06B 3/9628; E06B 3/9636; E06B 3/964; E06B 3/9644; E06B 3/9645; E06B 3/9646; E06B 3/822; Y10T 403/555; Y10T 403/4602; Y10T 403/72
USPC ..... 52/213–217, 204.55, 214, 204.57, 52/204.58, 204.62, 210, 204.7, 455–458
See application file for complete search history.

(56) References Cited

U.S. PATENT DOCUMENTS 1,431,071 A * 10/1922 Willhoite ..... E06B 9/52 160/372
2,703,159 A * 3/1955 Fleet ..... E06B 3/9682 29/517
3,434,749 A * 3/1969 Meyer ..... E06B 3/9685 119/269
3,698,114 A * 10/1972 Hirsch ..... A47G 1/0605 40/757
3,782,054 A * 1/1974 Goss, Jr. ..... E06B 3/9682 40/782
3,866,380 A * 2/1975 Benson ..... E06B 3/667 403/205
3,899,258 A * 8/1975 Matthews ..... E06B 1/32 403/292
3,949,526 A * 4/1976 Sherlock ..... E06B 3/221 49/501
4,013,371 A * 3/1977 Nagase ..... B62D 33/044 403/187
4,023,293 A * 5/1977 Murray ..... A47G 1/10 40/782
4,078,288 A * 3/1978 Abramson ..... E06B 3/34 29/407.09
4,154,034 A * 5/1979 Bursk ..... E06B 1/30 49/504
4,222,209 A * 9/1980 Peterson ..... E06B 3/667 403/295
4,683,634 A * 8/1987 Cole ..... E06B 3/667 29/412
4,719,729 A * 1/1988 Wynar ..... E06B 1/64 52/211

(Continued)

*Primary Examiner* — Joshua J Michener
*Assistant Examiner* — Kyle Walraed-Sullivan
(74) *Attorney, Agent, or Firm* — Carmen Pili Ekstrom

(57) ABSTRACT

A buildable, collapsible and lightweight screen comprising a frame constructed with at least two longitudinal profiles, at least two transverse profiles, having hollow extruded profiles and which include at least one inner groove which runs along one side, in a longitudinal direction. Each of said profiles, one or more panels of sheet material are confined within said frame along said inside groove, and connectors that align and fasten the longitudinal and transverse profiles by fasteners and connectors which act as intermediaries to avoid direct contact between these profiles. A method of assembling an adjustable frame assembly is also disclosed.

20 Claims, 11 Drawing Sheets

(56) References Cited

U.S. PATENT DOCUMENTS 4,831,804 A * 5/1989 Sayer ..... E06B 3/222 52/204.593
4,974,352 A * 12/1990 Shwu-Jen ..... A47G 1/10 40/783
5,431,211 A * 7/1995 Guillemet ..... E06B 9/52 160/381
5,465,537 A * 11/1995 Fullwood ..... E06B 3/00 52/202
5,494,369 A * 2/1996 Stock ..... E06B 3/9681 403/178
5,737,890 A * 4/1998 Heyden ..... F16B 12/22 52/455
5,779,384 A * 7/1998 Olsen ..... B29C 65/08 160/381
6,029,402 A * 2/2000 Carney ..... E06B 3/02 49/399
6,119,416 A * 9/2000 Larson ..... E06B 1/62 49/504
6,141,925 A * 11/2000 Halvorson, Jr. ..... E04B 2/7455 52/126.3
6,393,778 B1 * 5/2002 Ting ..... E06B 3/4609 52/204.5
6,530,183 B1 * 3/2003 Kuei-Yung ..... E06B 1/26 49/504
6,866,081 B1 * 3/2005 Nordgard ..... E06B 3/22 160/371
7,228,662 B1 * 6/2007 John ..... E06B 3/962 52/204.1
7,818,927 B1 * 10/2010 John ..... E06B 3/74 52/204.1
8,028,489 B1 * 10/2011 Lawrence ..... E06B 3/9641 52/204.57
2003/0233802 A1 * 12/2003 Lethers ..... E06B 7/32 52/458
2006/0016144 A1 * 1/2006 Jacobs ..... E05D 15/0669 52/455
2007/0094935 A1 * 5/2007 Molinari ..... E06B 3/822 49/503
2007/0180786 A1 * 8/2007 Sotuyo ..... E06B 5/003 52/456
2007/0272365 A1 * 11/2007 Wingert ..... E06B 9/52 160/98
2008/0271394 A1 * 11/2008 Hand ..... E06B 1/02 52/210
2011/0194886 A1 * 8/2011 Wu ..... E06B 3/9641 403/23
2012/0279166 A1 * 11/2012 Valler ..... E06B 3/16 52/656.2
2013/0064600 A1 * 3/2013 Tseng ..... E06B 3/9682 403/205
2013/0283723 A1 * 10/2013 Engstrom ..... E06B 3/96 52/656.9
2014/0053479 A1 * 2/2014 Valler ..... E06B 3/964 52/204.5
2014/0352239 A1 * 12/2014 Cho ..... E06B 9/02 52/202
2015/0267460 A1 * 9/2015 Header ..... E06B 1/524 52/204.5

* cited by examiner

ADJUSTABLE SCREEN FRAME ASSEMBLY

The application is a continuation in part of U.S. patent application Ser. No. 13/968,853 filed on Aug. 16, 2013, the contents of which are incorporated herein by reference.

FIELD OF INVENTION

The present invention generally relates to structures formed by panels made of rigid or semi-rigid materials associated with frames for the construction of doors, sliding screens, windows, enclosures and the like, and a method of assembling adjustable screen frame assembly. More particularly, it relates to novel connectors associated with new profiles whereby screens which are structurally strong, mountable, demountable, lightweight and adjustable by the user are used for the construction of doors, sliding screens, windows, enclosures and other similar structures.

BACKGROUND OF THE INVENTION

It is well known that reinforced buildable profiles with different structures made of aluminum and other materials such as window and door profiles were cut square at their ends. They are assembled together by means of screws. They are housed in spaces with previously extruded profiles for the purpose of receiving, wherein the profiles that are assembled orthogonally touch each other. These profiles are frameworks that may also have internal subdivisions within which are placed mirrors, blind and translucent panels and used, as windows, sliding doors or enclosures. In the industry, there are different distinguished ways to fasten the panels. It is contemplated that the placement of more than one of them in the same frame, such as windows with double or triple glass and distinguished details are sealed to prevent the passage of water with gaskets made of soft materials such as rubber or plastic and to prevent the passage of dust, even at the periphery of the frame, as is the case of felts. Additionally, detailed functionalities are incorporated and adaptability for use in hardware facilitating the movement of these structures and desired functionalities to open, move, close and secure the position thereof.

The known prior art describes constructions of various underlying screen for constructing sliding windows, screens and/or windows. For example, US Patent Publication 20020053164; US Patent Publication 20030205002; US Patent Publication 20050166494, US Patent Publication 20060059780; US Patent Publication 2007005148; US Patent Publication 20100005726; US Patent Publication 20100307077; U.S. Pat. No. 4,398,373; and U.S. Pat. No. D407,828, describe sliding door arrangements or enclosure functions which operate based on either complicated glides or require complex hardware and/or profiles that make them difficult to assemble or in need of professional tools for assembly. Moreover, such screens, enclosures or partitions of the prior art do not allow quick and convenient handling of various panels in a single unit, either on a door, window or enclosure to combine materials, colors and/or textures. Moreover, they do not allow the practical assembly of screens that can be adapted to particular needs regarding dimensions or aesthetic appearance of the consumer liking.

The partitions, panels or enclosures of the prior art and the structures that are assembled from it also presents problems in its construction, as is the case with heavy weight and is directly proportional to the strength of their structures. That is, if strong structures are desired, it is necessary to use metal profiles that yield strength, and on the other hand, stiffness. Furthermore, the use of structures made of metals is expensive.

Another problem with the panels or enclosures of the prior art is that usually the profiles with which the frames are assembled together is a drudgery and the assembly of such structures is more problematic when using fasteners screw type, rivets, and the like.

A further disadvantage of the panels or enclosures that are currently on the market, is that very few are destined to the concept of "do it yourself." The manufacturers of the products that target this market segment, neglect details such as the completion or finish of the panel and do not allow to conceal or disguise the cuts of the profiles that could be defective when cut by inexperienced hands or by amateurs to the extent required by the user.

The applicant, in accordance with the present invention has developed a novel set of profiles and connectors which outweigh the problems and disadvantages of the prior art. Moreover, they are combined to build practical screens which can be modular and which in turn result in constructions of the type such as doors, windows, screens, enclosures and other similar or equivalent elements having structural strength, lightweight and visually appealing finish.

SUMMARY OF THE INVENTION

The present invention relates to a mountable, demountable, detachable, and sizable screen, in an especially preferred embodiment, is used as a door, comprising a frame constructed from hollow, extruded profiles and preferably made from polyvinyl chloride (PVC). Other materials may also be used, such as metals. For example, profiles that are aligned by means of connectors at each joint with one or more wood fiber boards, or other rigid materials such as glass, mirror, rigid plastic panel, foam or hollow, which are confined in said frame.

In one embodiment of the screen of the invention, the hollow profiles having at least one longitudinal groove in the form of a simple "U" or modified form of angle and depth, on its outer wall, wherein said groove once the frame assembly comprising at least four hollow profiles, faces inwards the assembled frame and said groove into which the edges of the rigid panel which is confined in the frame are inserted.

In a further embodiment of the screen of the invention, the frames can be assembled with two longitudinal hollow profiles and at least two transverse hollow profiles which are different from the longitudinal. Optionally, it is possible to place a third transverse profile, equal to or different from the other transverse hollow profiles attached to both longitudinal profiles at an intermediate position between both hollow transversal profiles and parallel to said profiles both constituting the outer frame transversal sections. They can be attached at any distance that is intended by dividing the outer frame so that two rigid panels instead of one may be placed inside the frame and these divisions can keep repeating and adding more hollow transversal profiles. When there is an intermediate transverse hollow profile, like the case of a third or subsequent profile, said profile has a "U" shaped groove along at least two opposite longitudinal lines on its outer side, so that it can receive the edges of the rigid panels to be introduced on both sides.

In a further embodiment of the partition, enclosure, divider or panel of the invention, the hollow profiles are both longitudinal and transversal which allow insertion along their longitudinal axes structural filling elements that improve its resistance to bending, such as steel pipes, wood, other similar materials, or combination thereof.

In a further embodiment of the partition, enclosure, divider or panel of the invention, the hollow profiles are both longitudinal and transversal. Said profiles also allow the introduction of filler strips of wood or other similar material so that the screw fittings on the exterior surface of the hollow profiles and the threads of the bolts are resistant to substrates to be anchored inside.

In a further embodiment of the partition, enclosure, divider or panel of the invention, all of the referred profiles are perpendicularly cut to its longitudinal axis when assembled.

In a further embodiment of the partition, enclosure or panel of the invention, the longitudinal profiles allow the passage of screws transverse to its longitudinal axis.

In a further embodiment of the partition, enclosure, divider or panel of the invention, two or more transverse hollow profiles featured as a design profile, which receive the threads of the bolts in the direction of its longitudinal axis, are provided with at least a means for receiving said threads, is extruded to manufacture the profile, which is visible at both ends of the transverse hollow profiles.

In a further embodiment of the partition, enclosure, divider or panel of the invention, each screw connection between the two hollow profiles, one longitudinal and one transversal, there is a connector that prevents direct contact between both hollow profiles, as a gasket interposed therebetween.

In a further embodiment of the partition, enclosure, divider or panel of the invention, wherein the surface, within which each connector acts as a gasket, protrusions are projected longitudinally penetrating the ends of the transverse hollow profiles, in order to align the connector with the internal form of the transverse profile and ensure that no transversal deformation of the hollow profile occurs at the time of being assembled.

In a further embodiment of the partition, enclosure, divider or panel of the invention, wherein the surface, within which each connector acts as a gasket, a gasket contour wall protrudes covering the first few millimeters of length around the end of a transverse hollow profile, making said end not to be seen. This prevents cutting defects in one or both ends of the transverse hollow profiles to be shown, defects resulting from an inexperienced application or suboptimal tools. Despite described circumstances, said protruding contour wall ensures optimal partition, enclosure, divider or panel appearance.

In a further embodiment of the partition, enclosure, divider or panel of the invention, the connectors of the invention comprise projections which project perpendicularly from its gasket surface in a direction opposite to what has been described above, diverting away from the cutting surface of the hollow profile, so that, when connectors are positioned at the ends of a transverse hollow profile, said projections are external protuberances that engage and align with the groove in the shape of a continuous longitudinal "U" hollow longitudinal profiles show and are integrated for receiving rigid panels.

In a further embodiment of the partition, enclosure, divider or panel of the invention, the gasket surfaces of the connectors, which act as joints between the longitudinal and transverse hollow profiles having perforations through which the screw passes or wherein the profiles are assembled and presented. These same surfaces show through grooves to allow the passage of assembled panel edges through the connectors' gasket surface, letting simply square cut panels be framed inside longitudinal and transverse hollow assembly profiles without having to make any further operation on the panels prior to assembly.

In a further embodiment of the partition, enclosure, divider or panel of the invention, it also comprises an additional rib or profile which, have a smaller section than the longitudinal and transversal hollow profiles and having a groove in a "U" on both sides. The grooves which are inserted on the edges of the rigid panels which, when linked by each such rib, before being confined in the space defined by longitudinal and transversal hollow profiles assembly, it is possible that the two panels joined by said rib only occupy a space defined by the hollow assembly, may be of different materials or finish.

In a further embodiment of the partition, enclosure, divider or panel of the invention, the partition assembly allows the introduction of a guide element or protrusion profile that follows the longitudinal axis of a hollow transverse profile allowing to align the movement of the assembled partition, enclosure, divider or panel along a rail, a floor rail for example, said protrusion profile is simply attached to said hollow transverse profile by inserting it along the latter inside the form it is provided with to receive it.

Therefore, an object of the present invention is to provide a novel set of hollow profiles and connecting elements, specially designed particularly to combine and thus assemble frames for manufacturing partitions, enclosures, dividers or panels of the type used for the assembly of doors, windows, screens, enclosures and other similar constructions.

A further object of the invention is to provide a set of movable, mountable, demountable, separable or buildable elements of hollow and rigid panels that users can cut to the size at their own convenience for assembling panels, screens, dividers or partitions that can be used as enclosures, sliding doors and/or collapsible for closet, for example, which are lightweight, economical and easily adaptable to the size of the space available at the time of placement, as well as to ensure longer life of conventional hardware used for placement due to its low weight.

A further object of the invention to provide a movable, buildable, mountable, demountable or separable partition, enclosure, divider or panel, having only one panel thickness of view, instead of two as is the case of a hollow core sliding door closet. The profiles become more competitive due to its lighter weight, prolonged useful life and lower manufacturing cost.

Another object of the invention to provide a movable, buildable, mountable, demountable, separable or collapsible system component assembly of screens, which are handled separately as parts and/or modular packages with a variety of finishes and materials to manufacture enclosures, sliding doors and/or folding structures, likely to suit a variety of tastes and preferences to the consumer.

Yet another object of the invention is to provide movable, buildable, mountable, demountable, separable or collapsible partitions, dividers, panels or screens and comprised of parts, which are packed in convenient sizes for transport and handling in accordance with commercial formats and supply chain for easy transportation of the same by the users with their own vehicles without using cargo transport.

One more object of the invention is to provide components of a system construction of panels, partitions, dividers or screens, which are individually packaged so as to avoid damage or deterioration during transportation to the place of installation, where they are unpacked, assembled and built.

Another object of the invention is to provide a construction system of panels, screens, enclosures, sliding doors and/or folding, wherein the components are easy to handle and introduced at any room in which to adapt, assemble and install the system in a manner which is more practical, easier, faster and less expensive as compared with traditional systems comprising conventional hollow core doors. The traditional systems which are employed for regular closet doors or enclosures are wider than the door openings between rooms and the size of the structure results frequently in an impediment in carrying them. For example, for a bedroom, a user may need the enclosures, screens, panels or partition where there are staircases and other spaces which do not fit or difficulty exists associated with the risk of damaging the walls to perform maneuvers, or there is a risk of damage to the finish of the walls. Sometimes, the only way to enter the chamber is to manipulate the assembly through a window with a risk of accident.

Another object of the invention is to provide a building system that is movable, buildable or adaptable in a variety of sizes using rigid panels cut and obtained from original commercial sizes leaving zero waste using, for example wood 4'×8' fiber sheets, thus reducing cost.

Still another object of the invention is to provide a bulkhead, partitions, panels or screens in which components comprise attractive finish, flexible and customized by the user. For example, extruded profiles may carry metallic, printed or colored and panels may be opaque in multiplicity of finishing, or may be transparent (glass), reflective (mirror) or translucent and may carry finishes applied by the user as for example stretching fabrics over the panels before confining them in the frames.

Still another object of the invention to provide a bulkhead, partitions, panels or screens that can be assembled by the user by combining the color and texture characteristics of the panels according to their preference and decoration, combining different panels on a single project or jointing different panel materials within a single assembled frame using the above-described rib as the joint.

A further object of the present invention is to provide a panels, screens, dividers or partitions which are assembled by means of connectors which ensure no deformation of the profiles when constructed. Their construction permits use for thin walled extrusions or relatively soft materials such as PVC.

Another object of the present invention relates to a movable, buildable, separable, mountable, demountable, or collapsible divider, screen, partition or panel assembly comprising:

a frame construction comprising a pair of longitudinal profiles (stiles) and a top and bottom transverse profiles (rails) to define any suitable quadrilateral configuration; each of said longitudinal and transverse profile having a hollow extruded profile comprising at least one inner groove which runs along one side in a longitudinal direction of each of said profiles;

one or more panels of sheet rigid or semi-rigid material are confined within said frame along said inner groove, wherein the longitudinal profiles are attached to the transverse profiles through a plurality of aligned connectors and fastened by fasteners;

wherein said connectors comprising a gasket form configuration to allow protrusions and holes comprised by connector work alignment, cover defects, and reinforce joints to ensure proper fastener assembly;

said connectors comprising an accessory configuration for coverage of transverse profile ends to hide defects by hand cutting tools when said profiles were cut to final length;

said connector comprising a structural configuration to prevent profiles from deforming during fastener insertion;

said connector comprising a guide profile configuration to prevent fasteners from following a wrong track as they engage the transverse profiles;

said connectors comprising a defined protrusion and inserted to the inner groove of the longitudinal profile; wherein said protrusion penetrates the transverse profile for coherent coupling with the longitudinal profile by the fasteners;

wherein the longitudinal profiles comprise at least one additional second longitudinal groove in the form of "U" located on an opposite side to the inner groove, said second groove which hides fastening element heads which are fixed to the transverse profiles through the longitudinal profiles.

said final product of frame and profiles comprising design and functional flexibility, easy assembly and configuration, size and shape cut for users in accordance with availability of space.

Another object of the present invention relates to a movable, buildable, separable, mountable, demountable, or collapsible divider, screen, partition or panel assembly comprising:

a frame construction comprising a pair of longitudinal profiles (stiles) and a top and bottom transverse profiles (rails) to form an upper edge, lower edge and opposing side edges to define a quadrilateral configuration; each of said longitudinal and transverse profile having a hollow extruded profile comprising at least one inner groove which runs along one side in a longitudinal direction of each of said profiles;

one or more panels of sheet rigid or semi-rigid material are confined within said frame along said inner groove, wherein the longitudinal profiles are attached to the transverse profiles through a plurality of aligned connectors and fastened by fasteners;

wherein said connectors comprising a gasket form configuration to allow protrusions and holes comprised by connector work alignment, cover defects, and reinforce joints to ensure proper fastener assembly;

said connectors comprising an accessory configuration for coverage of transverse profile ends to hide defects by hand cutting tools when said profiles were cut to final length;

said connector comprising a structural configuration to prevent profiles from deforming during fastener insertion;

said connector comprising a guide profile to prevent fasteners from following a wrong track as they engage the transverse profiles;

said connectors comprising a defined protrusion and inserted to the inner groove of the longitudinal profile; said protrusion penetrates the bottom transverse profile for coherent coupling with the longitudinal profile by the fasteners;

an accessory member which cooperates with receiving a clamping or fastening element which joins together with said longitudinal and transverse profiles;

a rib profile member comprising grooves in opposing position to allow insertion of panels; said rib profile comprising at least two grip configuration arranged on the side panels to facilitate and secure assembly of panel;

wherein the longitudinal profiles comprise at least one additional second longitudinal groove in the form of "U" located on an opposite side to the inner groove, said second groove which hides fastening element heads which are fixed to the transverse profiles through the longitudinal profiles;

said final product of frame and profiles comprising design and functional flexibility, easy assembly and configuration, size and shape cut for users in accordance with availability of space.

Another object of the present invention is to provide a method for assembling screen frame assembly comprising a pair of rail and stile profile members optionally having structural filling material, the method comprising the steps of:

a) determining the location for the frame assembly and measuring the proper dimensions of the opening;

b) cutting rail profile members, stile profile members and panel materials to a desired dimension;

c) inserting reinforcement element or connector on the edge of the rail profile member such that the protrusions face inward the rail hollow profile alignment;

d) positioning the connector with rail profile member fastener's threads receiving sleeves comprised by the rail profile;

e) providing said connector covering the outer perimeter of the rail profile member end to hide defects resulting from the use of house hold tools;

f) cutting the rail profile member to final length;

g) providing said connector comprising protrusions facing outward said rail profile member;

h) designing said protrusions to engage the "U" shaped grooves located along stile member profiles to provide proper rail-stile alignment before fasteners are inserted;

i) passing the fasteners through holes of said connector; said connector further comprising protrusions facing inward rail profile member, such that protrusions engages the rail member fasteners' threads receiving sleeves;

j) completing a round through pass path for fastener assembly; said protrusions preventing fasteners to follow a wrong path during assembly;

k) joining the rail and stile profile elements together, with reinforcement, cut covering elements or connectors in between and fastening all three elements using fasteners;

l) inserting pre-cut panels into both sides of rib elements' "U" shaped grooves;

m) disposing the panel along the groove of each rail profile member and each stile profile member such that each of the rail profile member and stile profile member surrounds the panel;

n) inserting a plurality of rail connectors to the rail profile member adjacent to the stile profile member; said connectors comprising a gasket form configuration; said connectors comprising protrusions designed to prevent unclean look of profile length cuts made with household tools; said connectors used for coverage of transverse profile ends to hide defects by hand cutting tools when said profiles were cut to final length;

o) preventing profiles from deforming during fastener insertion; preventing fasteners from following a wrong track as they engage the transverse profiles; and providing coherent coupling with the longitudinal profile by the fasteners.

BRIEF DESCRIPTION OF DRAWINGS

The invention may take physical form in certain elements and arrangements different, some preferred embodiments of which are described in detail in the detailed description of the invention and illustrated in the accompanying drawings which form a part thereof, and wherein.

DETAILED DESCRIPTION OF INVENTION

As used herein, the term "transverse profile" also refers to rails. As used herein, the term "longitudinal profile" also refers to stiles.

Figure 1:
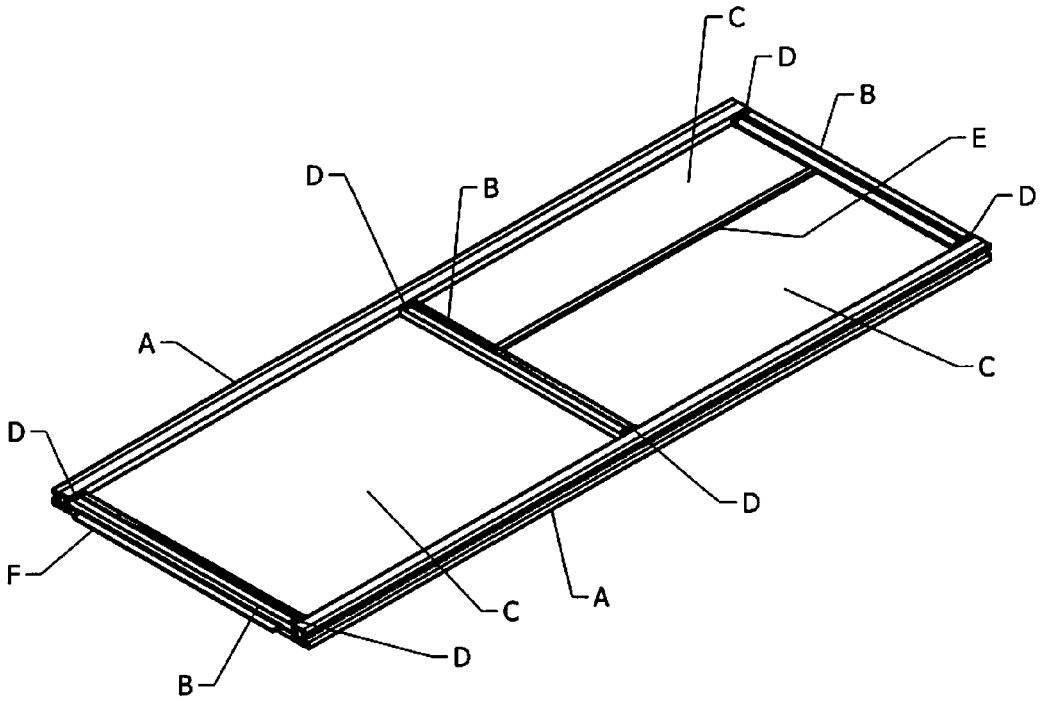
FIG. 1 illustrates a perspective view of a panel or partition conventionally assembled in accordance with the principles of the present invention and in which easily seen components of said panel or partition are distinguished.
Figure 1A:
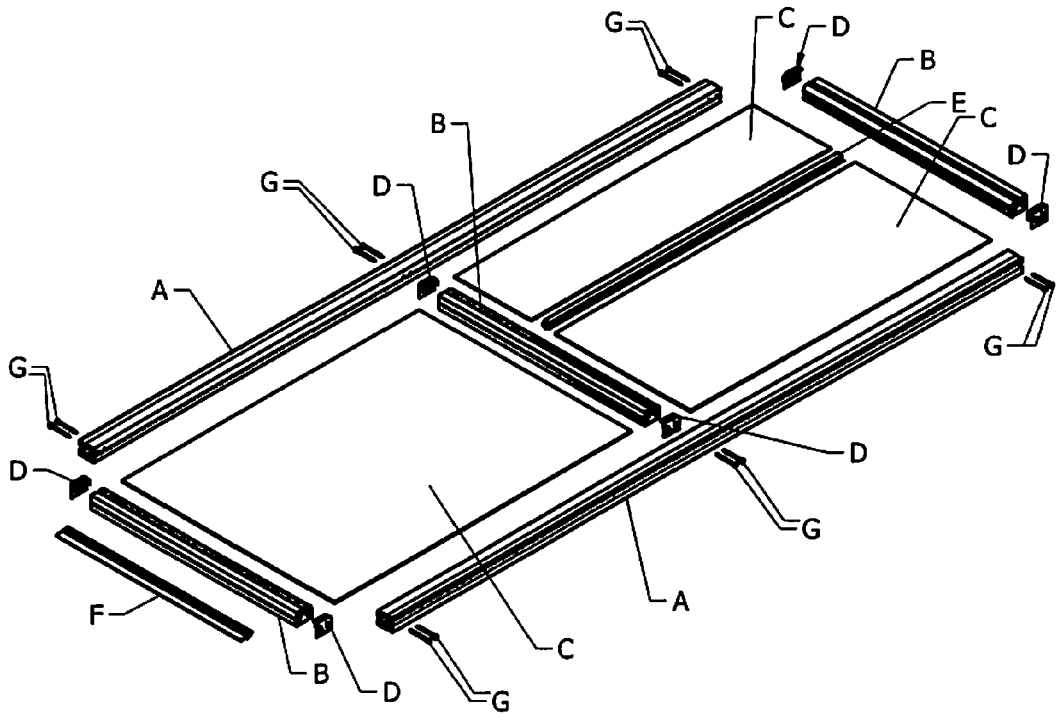
FIG. 1A is a perspective view of the conventional partition of FIG. 1, exploded and in which its different components are distinguished.

In the description that follows, it should be understood that when referring to "one partition" can mean either a segment or the segments formed by the longitudinal profiles (A) and transversal (B) and Panels (C) illustrated in FIGS. 1 and 1A, or the complete set formed by said segments.

The following describes preferred embodiments of the invention and according to the drawings of FIGS. 1, 1A, 2, 2A, 2B, 2C, 3, 3A, 3B, 3C, 3D, 4, 4A, 5, 6, and 7, with the sole purpose of illustrating it better, but certainly it should be understood that this is not limiting the scope of the same.

In an especially preferred embodiment, the invention provides a divider, partition, panel or screen comprising a perimetric frame formed by two longitudinal profiles A, FIGS. 1 and 1A, preferably both hollow as PVC extrudates, fastened with fasteners of the type of screws, rivets, and/or glued or toothed bolts G, FIG. 1A to two transverse profiles B, FIGS. 1 and 1A, also preferably hollow such as PVC extrudates. The framework which is confined within a rigid panel C, FIGS. 1 and 1A, simply cut square, which may be of wood fiber or other rigid material, preferably glass, mirror, rigid plastic panel, hollow or foamed.

While said panel remains confined within the frame, under which two of its opposite edges are inserted in the grooves 6, FIGS. 2, 2A, 2B and 2C, when joined to longitudinal profiles A, FIGS. 1 and 1A, panels wherein two remaining opposite edges are inserted in the remaining transverse profile grooves 13, FIGS. 3, 3A, 3B, 3C and 3D, as said edges are attached to the transverse profiles B, FIGS. 1 and 1A. The transverse profiles can be more than two with the frame that forms the perimeter by virtue of which it is possible to connect a larger number of transverse profiles B, FIGS. 1 and 1A, at both longitudinal profiles A, FIGS. 1 and 1A, at preferred position. Then dividing the interior space of the frame in more than one segment to confine the space or rigid panels C, FIGS. 1 and 1A. The transverse profiles B, FIGS. 1 and 1A, which are joined to the longitudinal profiles A, FIGS. 1 and 1A, without the two elements touching each other because they are sandwiched between connector D, FIGS. 1, 1A, 5 and 6 which can be left or right as needed and which has the function of ensuring proper alignment between said assembled profiles A and B, FIGS. 1 and 1A, to prevent possible deformation of the transverse profiles B, FIGS. 1 and 1A, when assembling and to cover presumably poor cutting finishing at on one or both ends of the transverse profiles B, FIGS. 1 and 1A, when they are cut by the user before assembly, covering provided in order to obtain a partition to the desired size and neat appearance.

Figure 4:
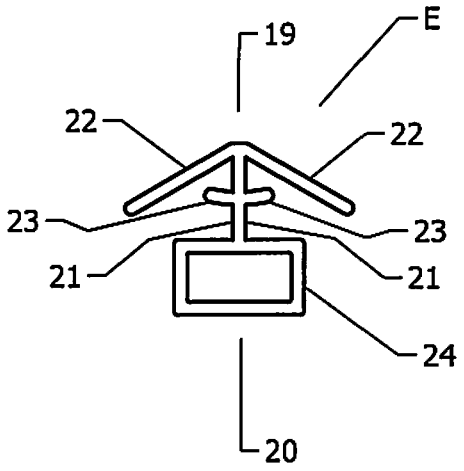
FIG. 4 is a cross sectional view of a rib profile, illustrated with reference E, of the type used for the bulkhead, screen, partition, or panel assembly of FIG. 1.
Figure 4A:
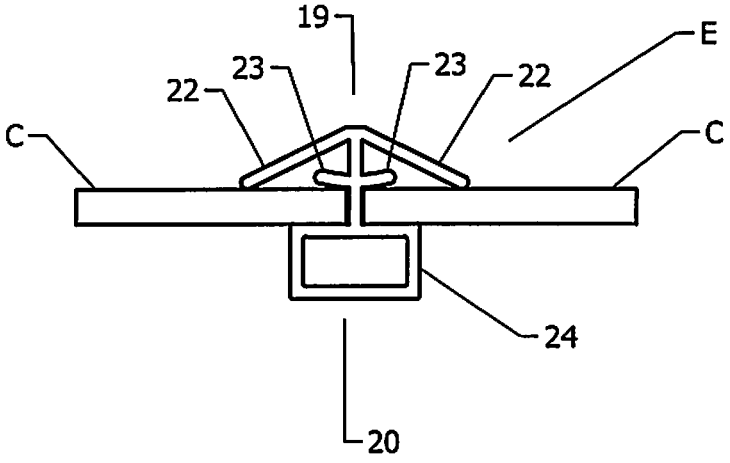
FIG. 4A is a cross-sectional view of a rib profile (E) illustrated in FIG. 4, attached to two panels (C), of the type used for the bulkhead, screen, partition, or panel assembly of FIG. 1.

In an especially preferred embodiment, the invention includes a rib profile E, FIGS. 1, 1A, 4 and 4A, which has grooves 21, FIG. 4, in opposed positions, to allow insertion of the edges of panels C, FIGS. 1, 1A, and 4A, at opposite positions. So that by using one of these rib profiles E, FIGS. 1 and 1A, it becomes possible that in a single aperture formed by the assembly of profiles A and B, FIGS. 1 and 1A, it is possible to introduce more than one panel section C, FIGS. 1 and 1A, in such a way that there are two or more vent panels C, FIGS. 1 and 1A, joined at their edges. There is then the advantage that the sections of panel C, FIGS. 1 and 1A, can be designed based on the desired dimensions of the screen object of the invention. While it is possible to use sections of panels C, FIGS. 1 and 1A, which are of multiple size or to utilize more convenient size without wasting commercial size panels for manufacturing the object screens of this invention, it is also achieved, by incorporating the rib profile E, FIGS. 1 and 1A, the possibility of changing the material, for example, of rigid panel of wood fiber side of the rib profile E, FIGS. 1 and 1A, a glass or plastic translucent material across the rib profile E, FIGS. 1 and 1A, resulting in increased functionality of the enclosure object of the invention.

According to a preferred embodiment of the invention, at the ends of the partition, it is possible to add guide profiles F, FIGS. 1 and 1A also introduced into the slots 13, FIGS. 3, 3A, 3B, 3C and 3D, cross profiles B, FIGS. 1 and 1A, positioned at the ends of the longitudinal profiles A, FIGS. 1 and 1A. The said profiles having guide assemblies F, FIGS. 1 and 1A, the ends of the enclosure object of this invention exhibit protrusions that can slide transversely in rails (not shown) both above and below. This is an option for the screen object of this invention, i.e., can be operated as a sliding door or in lieu of such guide rail F, FIGS. 1 and 1A, might adhere to the screen object of this invention, conventional fittings for doors or enclosure sliding operation on the market.

Figure 2:
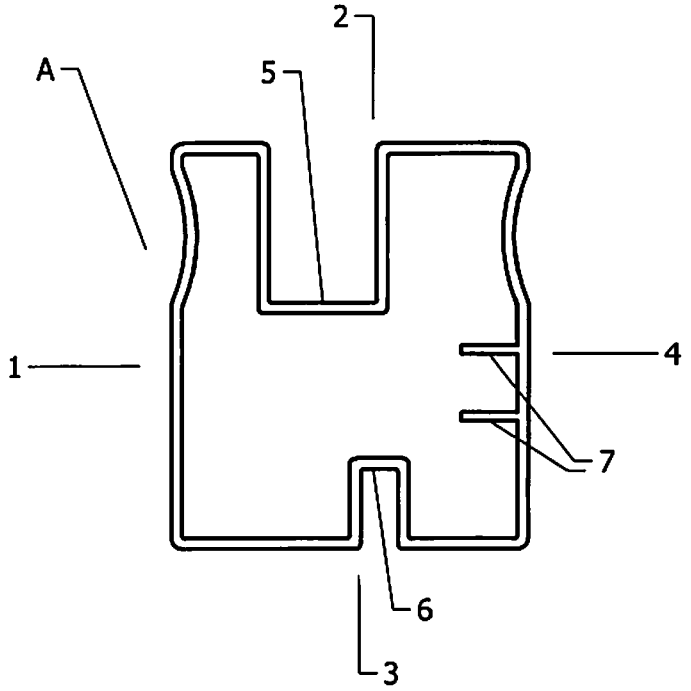
FIG. 2 is a cross sectional view of a first embodiment of a hollow longitudinal profile of the type used for assembling a bulkhead, partition, panel or screen frame.
Figure 2A:
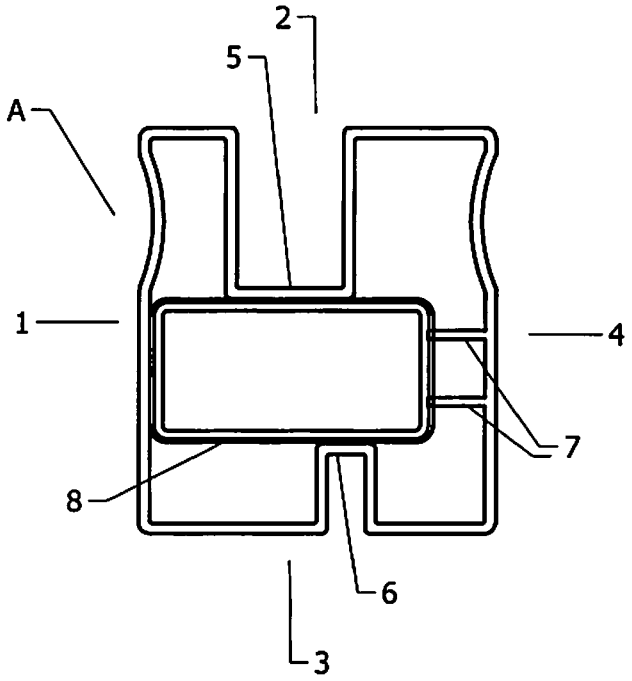
FIG. 2A is a longitudinal view of the hollow profile of FIG. 2, in which is inserted a tubular steel to improve its resistance to bending, the insert can also be of other materials.
Figure 2B:
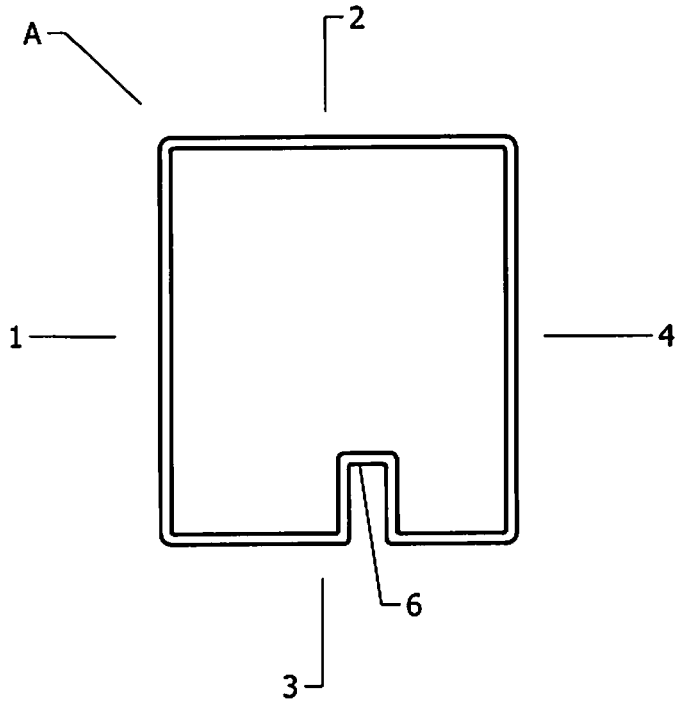
FIG. 2B is a cross sectional view of a second embodiment of a hollow longitudinal profile of the type used for assembling a bulkhead, partition, panel or screen frame.
Figure 2C:
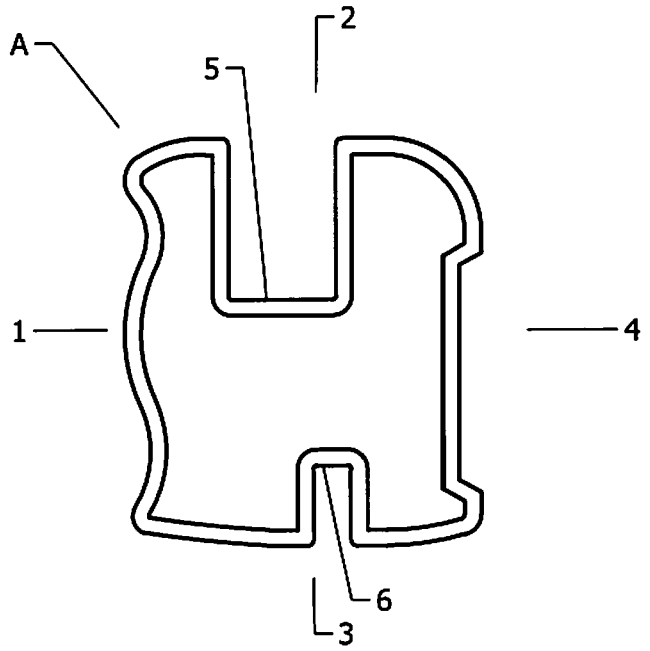
FIG. 2C is a cross sectional view of a third embodiment of a hollow longitudinal profile of the type used for assembling a bulkhead, partition, panel or screen frame.

In one embodiment of the invention, the longitudinal profile A, FIGS. 1, 1A, 2, 2A, 2B and 2C, is preferably a hollow profile such PVC extrudates, which is capable of receiving therein reinforcing inserts 8, FIG. 2A. This is employed to improve its mechanical capabilities. Inserts can be of a variety of materials. Longitudinal profile A, FIGS. 1, 1A, 2, 2A, 2B and 2C, outer surface may be finished in solid color, translucent or transparent, metallic or pearly appearance, according to the formulation of the compound is extruded and supports laminated finishes on the outside of the wall as a lining which may even be printed, textured, or both.

In this embodiment, each longitudinal profile is characterized by four sides which are: Side 1, FIGS. 2, 2A, 2B and 2C is its side view, which coincides with the main view side panels C, FIGS. 1 and 1A. This is therefore part of the main view screen object of this invention and may be varied at will forms and/or taste of the designer in order to achieve better acceptance of the screen by the user. There is a possibility that the side 1, FIGS. 1, 1A, 2, 2A, 2B and 2C, is flat or has grooves, broken or curved forms suitable for better grip profile A, FIGS. 1 and 1A, to manipulate the screen comfortably object of this invention or just to please the user. Side 2, FIGS. 2, 2A, 2B and 2C, which corresponds to the outer longitudinal edge of the screen object of this invention, which may be flat, curved or otherwise, to the side which in this preferred embodiment has been defined nonessential existence of a groove 5, FIGS. 2, 2A and 2C. This has the purpose of allowing penetration of the heads of screws or other fasteners G, FIG. 1A, which are used to assemble the partition object of this invention. Clamping element G passing through the longitudinal profiles A, FIGS. 1 and 1A, from one side to another of its section before receiving anchored on sleeve receptor 15, FIGS. 3, 3A, 3B, 3C and 3D. This is intended for it in the transverse profiles B, FIGS. 1, 1A, 3, 3A, 3B, 3C and 3D, so that the heads of the clamping elements G, FIG. 1A, are seated in the bottom of the grooves 5, FIGS. 2, 2A and 2C, making it difficult for the user to notice their presence when facing panels C, FIGS. 1 and 1A, the bulkhead of the invention, once armed. Slot 5, FIGS. 2, 2A and 2C along which it is also possible to introduce an additional and even conventional element, such as a hose or flexible material profile that serves as a cover to conceal the presence of the clamping elements G, FIG. 1A. If such a flexible profile projects beyond side 2 outer surface, FIGS. 2, 2A and 2C, can function as a stop which provides softness to the contact side 2, FIGS. 2, 2A and 2C, against a wall limit of movement when the partition object of the invention is used as a sliding element on one or two rails (not shown) and rests against said side wall which limits the movement of the bulkhead.

Side 3, FIGS. 2, 2A, 2B and 2C, the side corresponding to the longitudinal profile A, FIGS. 1 and 1A presents into the frame formed by assembling longitudinal profiles A, FIGS. 1 and 1A, said side also presented to transverse profiles B, FIGS. 1 and 1A. Side 3 that can be of any shape provided that it has made a slot 6, FIGS. 2, 2A, 2B and 2C, always necessary, since said slot houses the edge of board C, FIGS. 1 and 1A, a board that is confined in each frame formed by the profiles A and B, FIGS. 1 and 1A.

Side 4, FIGS. 2, 2A, 2B and 2C, which is the rear side of the bulkhead longitudinal profile of the invention and which is the side having the longitudinal profile towards the side opposite the main view. The side which may be of any shape depending on the shape of the longitudinal profile, FIGS. 1 and 1A, so that its rear side or surface 4, FIGS. 2, 2A, 2B and 2C, is optimal for the convenience of manipulation of the bulkhead to the invention. Given that it is the rear side 4, FIGS. 2, 2A, 2B and 2C, this being the side suitable to incorporate more functionality detail as one or more longitudinal protrusions 7, FIGS. 2 and 2A, which project into longitudinal profile section, FIGS. 1, 1A, 2 and 2A allows obtaining an optimum dimension within the longitudinal profile, FIGS. 1, 1A, 2 and 2A, to insert structural reinforcement elements 8, FIG. 2A, which are of commercial size. The provision of longitudinal protrusions 7, FIGS. 2 and 2A, on the rear side 4, FIGS. 2 and 2A, the longitudinal profile A, FIGS. 1 and 1A due to the existence of the protrusions tends to create finishing defects along the outer surface of the extrusion when it is plastic, on the opposite side of the wall from which they project, being the rear side 4, FIGS. 2, 2A, 2B and 2C, more appropriate to allow these potential defects.

Figure 3:
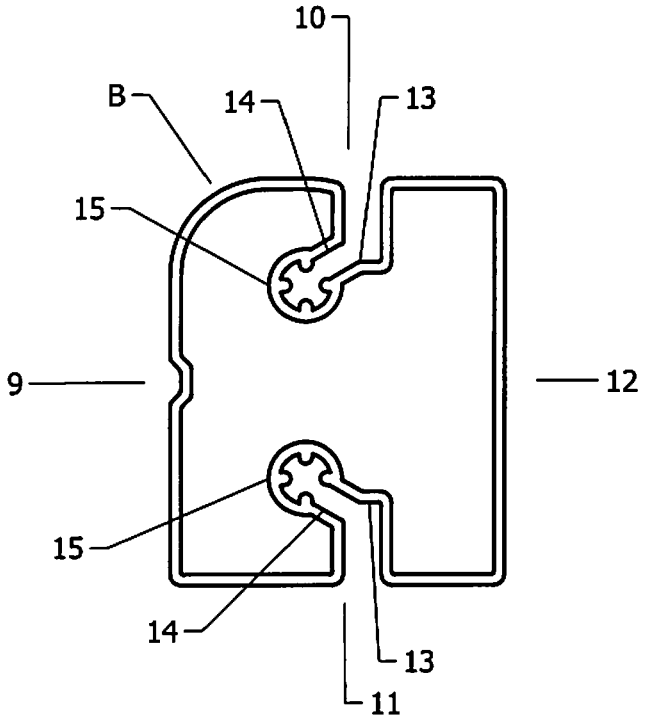
FIG. 3 is a cross sectional view of a first embodiment of a transverse hollow profile type which is used in assembling a bulkhead, partition, panel or screen frame.
Figure 3A:
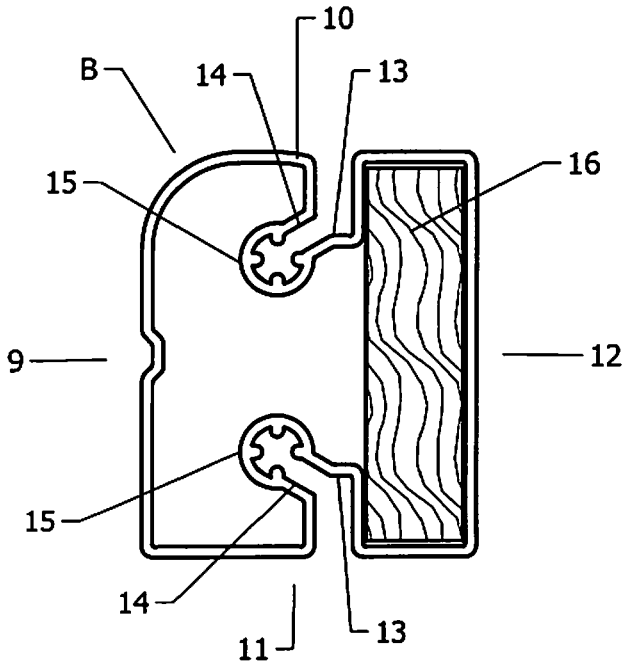
FIG. 3A is a cross-sectional view of the hollow profile of FIG. 3, in which is inserted a strip of wood, for example, to facilitate anchoring of fixing screws fittings; insert can also be of other materials.
Figure 3B:
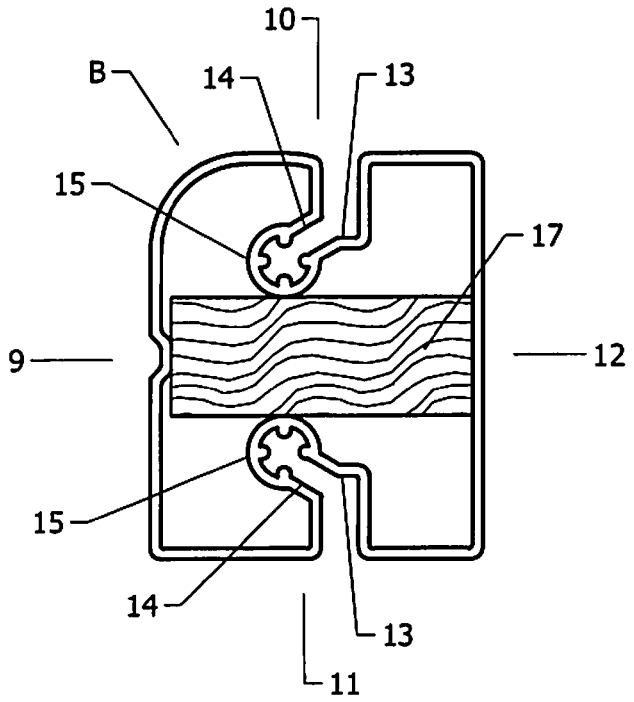
FIG. 3B is a cross sectional view of the profile illustrated in FIG. 3A, which has wooden strip inserted in a different arrangement to that of FIG. 3A to improve its resistance to bending, it can also be embedded in other materials.

In a preferred embodiment of the invention, the cross section B, FIGS. 1, 1A, 3, 3A, 3B, 3C and 3D, is preferably a hollow profile such as PVC extrudate, which is capable of receiving therein reinforcement inserts 16, FIGS. 3A and 17, FIG. 3B, which improves its mechanical capabilities. Inserts may be of a variety of materials and profile B, FIGS. 1, 1A, 3, 3A, 3B, 3C and 3D outer surface may be finished in solid color, translucent or transparent, metallic or pearly appearance, according to the formulation of the extruded compound or may allow laminated coverings or transferred finishing on its outer wall that may even be printed, textured, or both.

In this embodiment, each transverse profile B is characterized by four sides, namely: side 9, FIGS. 3, 3A, 3B, 3C and 3D, which is its side view, the side coinciding with the main view of the panels C, FIGS. 1 and 1A. This is therefore part of the main view screen object of this invention and can have different shapes at will and/or taste of the designer, in order to achieve better acceptance of the partition by the user. There is a possibility that the side 9, FIGS. 3, 3A, 3B, 3C and 3D, is flat or has grooves, broken or curved shapes that highlight their pleasing appearance to the user.

Sides 10 and 11, FIGS. 3, 3A, 3B, 3C and 3D, which sides correspond to the transverse profiles B, FIGS. 1 and 1A, presented to the interior of the frames formed with the longitudinal profiles A, FIGS. 1 and 1A and transverse B, FIGS. 1 and 1A. The sides can be of any shape provided they have integrated a groove 13, FIGS. 3, 3A, 3B, 3C and 3D, always necessary in any of the sides 10 and 11, FIGS. 3, 3A, 3B, 3C and 3D, since in these grooves 13 work as housing for the edges of the panels C, FIGS. 1 and 1A, which are confined in each frame formed by the profiles A and B, FIGS. 1 and 1A. These grooves 13, FIGS. 3, 3A, and 3B, are not closed at the bottom because this is used to continue with further extensions 14, FIGS. 3, 3A, and 3B, and ending with sleeve receptor 15, FIGS. 3, 3A, and 3B. This is designed to receive, when moving axially, the spiral threads of the clamping elements or screws G of FIG. 1A, that ensure the assembly of the various elements of the enclosure object of the invention. The structures formed by the elements 13, 14 and 15, FIGS. 3, 3A, and 3B, to be joined or defining a continuous path, allowing the post-formed tooling extruded profile, reaches the interior of the sleeve receptor 15, FIGS. 3, 3A, and 3B, guaranteeing its shape and position and then facilitating the assembly of the ends of the transverse profiles B, FIGS. 1 and 1A, when adjoining connectors D, FIGS. 1, 1A, 5 and 6 which can be fitted into said ends. According to a preferred embodiment, said connector elements are manufactured with a casting mold, therefore with greater precision than plastics profile extrusion, then the structures formed by the elements 13, 14 and 15, FIGS. 3, 3A, and 3B allowing better controlled dimensions and positions for sleeve receptor 15, FIGS. 3, 3A, and 3B, in comparison to the wider range of variability in dimension and position of the sleeve receptor 15, FIG. 3C, that does not have the above structure and arrangement of the elements 13, 14 and 15, FIGS. 3, 3A and 3B, sleeve receptor 15, FIG. 3C, left at a point in which no tooling can achieve its post-forming, then eliminating the possibility of fine control of its shape, size and position.

Figure 7:
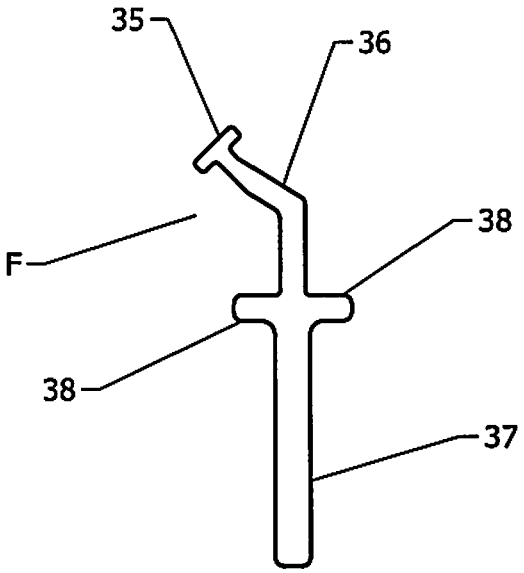
FIG. 7 is a cross sectional view of a guide profile illustrated with the reference F, of the type used for the bulkhead, screen, partition, or panel assembly of FIG. 1.

In FIGS. 3, 3A, 3B and 3D, the prolonged groove is formed by the elements 13, 14 and 15, FIGS. 3, 3A, and 3B, and as already mentioned, also enable the axial insertion of the guide profiles F, FIGS. 1, 1A, and 7, which are supported directly from sleeve receptor 15, FIGS. 3, 3A, and 3B. As shown in the drawing of the guide profile section F, FIG. 1A, which section is detailed in FIG. 7, it exists in a thickened wall 35, FIG. 7, designed to be inserted axially into the sleeve receptor 15, FIGS. 3, 3A, and 3B, so that the guide profile F, FIG. 1A and FIG. 7, be engaged to the structure formed by the elements 13, 14 and 15, FIGS. 3, 3A, and 3B, which is either on side 10, FIGS. 3, 3A, and 3B, or side 11, FIGS. 3, 3A, and 3B, on one of the transverse profiles B, FIG. 1, assembled perpendicularly to the ends of the profiles A, FIG. 1, so that the extension 37, FIG. 7, the guide profile F, FIGS. 1, 1A and 7, extends beyond the boundary of the transverse profiles of said full B, FIG. 1. Therefore, the aforementioned extensions 37, FIG. 7, protrude beyond the total length of the longitudinal profiles A, FIG. 1, where the guide profiles F, FIGS. 1, 1A and 7 are placed. These extensions allow the outgoing bulkhead object of the invention to be guided in parallel rails (not shown) to the transverse profiles B, FIG. 1, which is movable. The said guide profile F, FIGS. 1, 1A, 7, can not move and dislodge through the tip of the profile B, FIGS. 1 and 1A, by virtue of its limited axial movement by the existence of the clamping elements G, FIG. 1A, which prevent the passage.

Finally, side 12, FIGS. 3, 3A, 3B, 3C and 3D, which is the rear side of the bulkhead transverse profile B of the invention and which is the side having said transverse profile towards the side opposite the main view. The side which may be of any shape depending on the shape of the transverse profile, FIGS. 1 and 1A, being said side most suitable for allowing more unattractive elements derived from the manufacturing process.

According to embodiments of the invention, the rigid panels C, FIGS. 1 and 1A, are panels that other materials may be made from wood fiber, cardboard, chipboard, plywood, glass, mirror, solid plastic, foam plastic, or mixed wood and plastic compound. Depending on the material they are made of, they are able to receive finishing by painting, printing, or texturing and are characterized because, to be assembled with the other elements of the screen object of the invention, they require no further machining, recesses or anything but cutting their size to square angles, which can be practiced with rudimentary tools or even by non-specialists or unskilled personnel such as a home user, to size the dimensioned panels C, FIGS. 1 and 1A, according to the individual dimensions of the space required in place. Some cuts may end up hidden in grooves 6, FIGS. 2, 2A, 2B and 2C of the longitudinal profiles A, FIGS. 1, 1A, 2, 2A, 2B and 2C. Other cuts may remain hidden in grooves 13, FIGS. 3, 3A, 3B, and 3D of the transverse profiles B, FIGS. 11A, 3, 3A, 3B, 3C and 3D, or are hidden in grooves 21, FIG. 4, of the outlines rib E, FIGS. 1 and 1A integrated to the bulkhead of the invention. All mentioned grooves have a width suitable for the thickness of the panel C, FIGS. 1 and 1A, used to build a screen according to the invention and according to the function it may be given, depending on the dimensions required, and finish and use, a user intends to give.

According to an especially preferred embodiment of the invention, the connectors D, FIGS. 1, 1A, 5 and 6 are preferably pieces produced by injection in casting molds which may be of plastic or metal or other similar material, or can be obtained by stamping so that one can get different finish, colors and textures. These connections D may be left or right to be placed at the ends of the transverse profiles B, FIGS. 1 and 1A. It depends on whether the form of such transverse profiles B demands. These connectors D which are interspersed in each assembly is assembled between longitudinal profiles and transverse profiles B, causing both mentioned profiles not touching each other directly.

Figure 5:
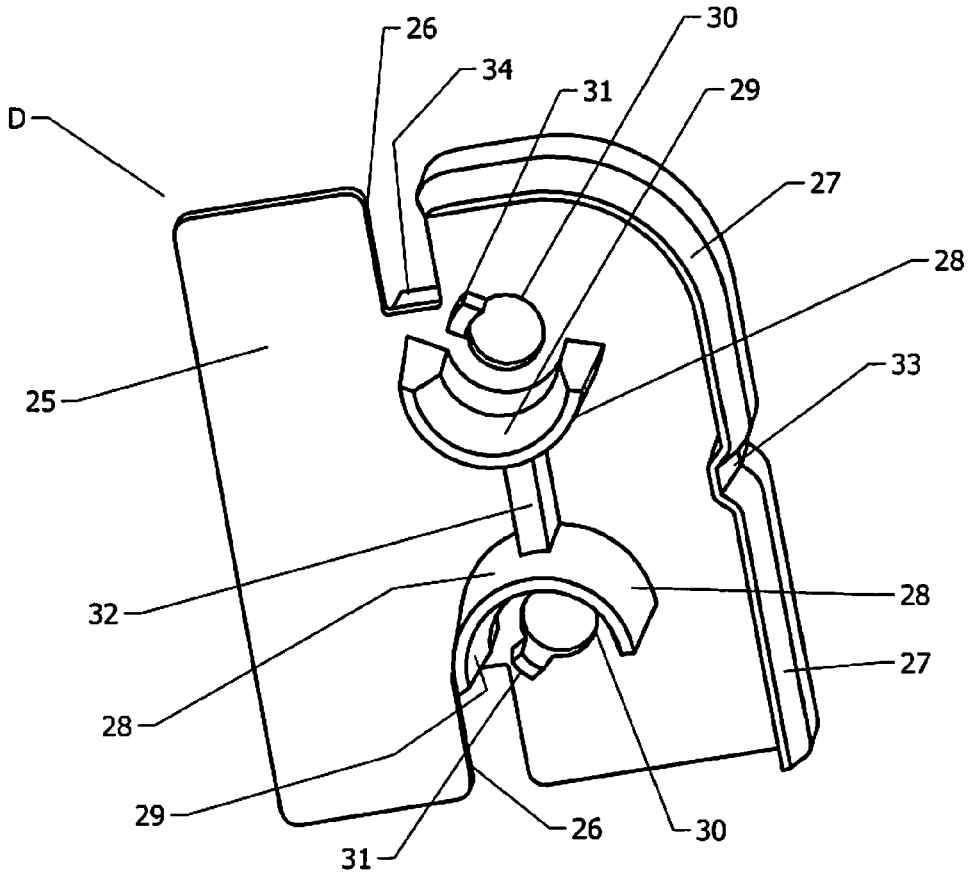
FIG. 5 is a perspective view of a conventional connector (D), seen from the side which penetrates a transverse hollow profile of the type illustrated in FIG. 3.

In a preferred embodiment, each of the connectors D is characterized by being composed of the following elements or components, with particular reference to FIG. 5 of the accompanying drawings: A seat gasket 25 which is flat on the inside D. Connector Flat surface which rests against the square cut from each end of a cross profile B, and within which penetrate the structures 28, 31 and 32.

Each of the two structures 28 is a rigid shell seat which surrounds at least part of the perimeter of the sleeve receptor 15, FIGS. 3, 3A and 3B, which are exposed at both ends of the profiles B, so as to embrace, the said sleeve receptor 15 and can not move from its place by the stresses to which they are subjected when a clamping element or screw G, FIG. 1A, makes its way and anchors its spiral thread in said sleeve receptor 15. The fixed position of the sleeve receptor 15 is guaranteed for receiving the aforementioned process even though the material from which it is made said profile portion B which are relatively soft, such as structures 28 hold down sleeve receptor 15 which are attached, due to the existence of a taper 29 that permits the structures 28 progressively hold down the outer walls of the sleeve receptor 15, FIGS. 3, 3A, and 3B, the connector D to infiltrate, at each end of the transverse profiles B. The previous description is the reason that the connectors D help maintain the rigidity of the armed assemblies between the longitudinal profiles and the transverse profiles A and B, although the latter may be made of a relatively soft material such as PVC.

Continuing with reference to FIG. 5, on the inner side of the connector D is located the wall 32, which protrudes perpendicularly to the inner surface of the wall, seat gasket 25 which connects the two enclosures 28 to unite and increase the rigidity of the relative position between the latter, thereby improving the mechanical behavior of resistance to deformation of the connection between each connector D and end of B in the cross section profile that it penetrates.

The gasket comprises holes and protrusions that provide the novel properties of the present invention in the assembly of lightweight material profiles, e.g., PVC profiles that easily deform when assembled and stressed by shearing force of engaging fastener threads. The protrusions are designed to prevent unclean look of profile length cuts made with household tools.

The connectors are positioned with the rail profile fastener's threads receiving sleeves comprised by the rail profile. The protrusions 28 as shown in FIG. 5 surround fasteners receiving sleeves 15 as shown in FIG. 3. The protrusions comprise an internal cone shape or slope 29 on each protrusion 28 as shown in FIG. 5, while connector D as shown in FIG. 5 is inserted on a rail end. The said internal cone shape or slope progressively compresses each fastener receiving sleeve outline, thus ensuring said receiving sleeves to stay tightly in place in relation to the connector's fastener through passing holes 30 as shown in FIG. 5 ensuring fasteners will configure the holes at the time of insertion. The connector covers the outer perimeter of the rail profile end to hide defects resulting from the use of household tools. The protrusion 27 as shown in FIG. 5 surrounds at least part of the rail end outline B as shown in FIG. 5.

Figure 6:
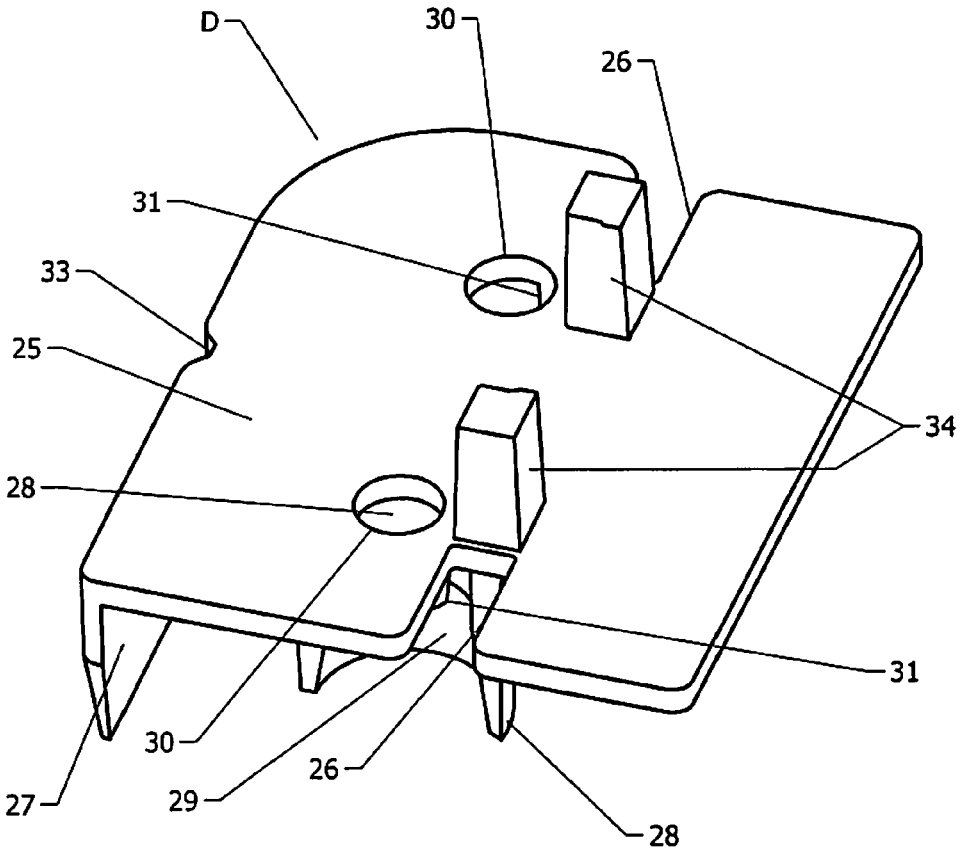
FIG. 6 is a conventional perspective view of the connector of FIG. 5, seen from the opposite side to that illustrated in FIG. 5, which enters the channel in a "U" on one longitudinal side of the hollow profile as shown in FIG. 2.

There are two holes 30 which can be viewed both by the inside of the connector D, as for the outside of the connector. As shown in FIG. 6, the holes have the purpose of permitting the passage of clamping elements G which penetrate the gasket so as to join the longitudinal profiles and the transverse profiles A B, passing freely through the holes 30. The connector comprises protrusions 34 facing outward the rail profile as shown in FIG. 6. The protrusion not being a part of rail is barely shown in FIG. 5. The protrusions that face outward the rail end once the connector is inserted, protrusions permit designing the protrusions to engage the "U" shaped grooves located along the stile member profile to provide proper rail-stile alignment before fasteners are inserted.

Adjacent to orifices 30, and the flat inner side of the gasket 25, there is at least one projection 31, FIGS. 5 and 6, which grows in parallel to the structures 28 and projections 31 are such that one of their sides is the axial extension of the internal perimeter of each of the two holes 30, while the rest of the body of the projections is inserted into the extensions 14, FIGS. 3, 3A and 3B of the ends of the B profiles when inserting D connectors into said ends. The result is that the space for the passage of the clamping elements G, has a limit or stop that prevents said clamping element G to deviate from its desired path when being assembled to the interior walls of sleeve receptor 15, FIGS. 3, 3A and 3B since such projections 31, embedded in the extensions 14, FIGS. 3, 3A and 3B, prevent any deviation occurrence.

Figure 3C:
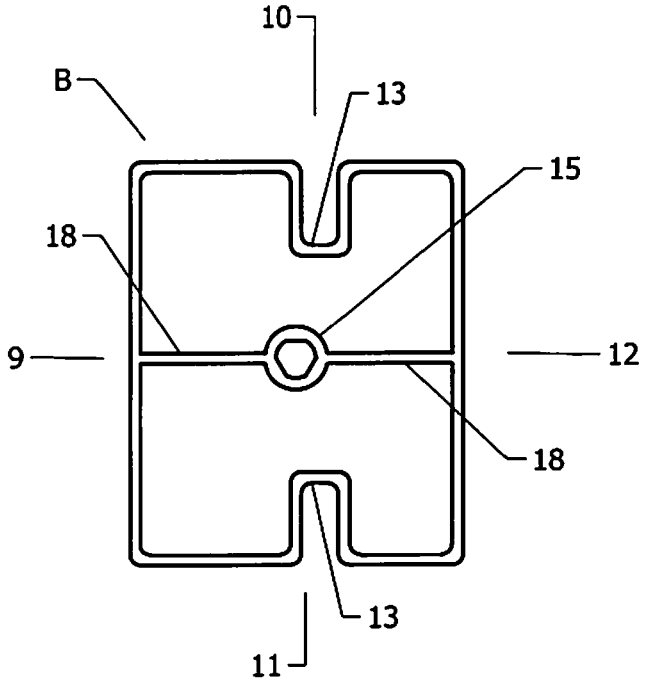
FIG. 3C is a cross sectional view of a second embodiment of a transverse hollow profile of the type used in the assembly of a partition, panel or screen frame.
Figure 3D:
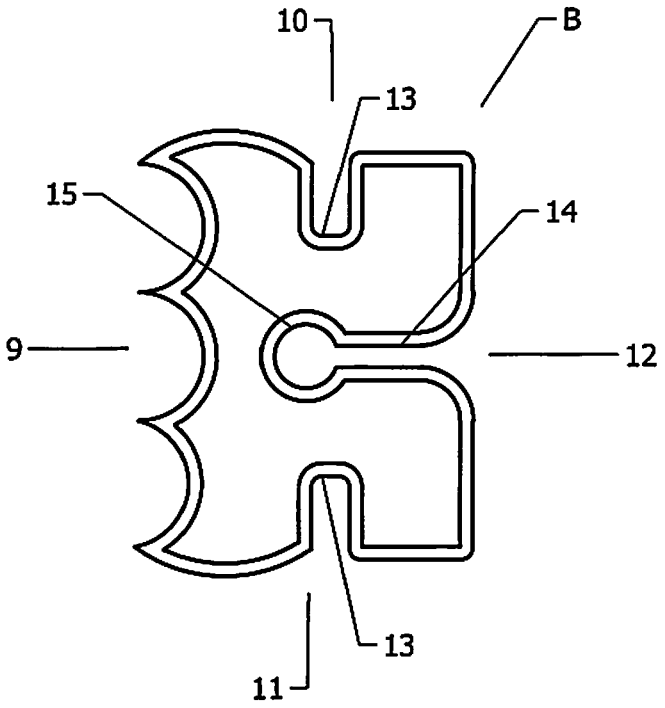
FIG. 3D is a cross sectional view of a third embodiment of a transverse hollow profile type which is used in assembling a bulkhead, partition, panel or screen frame.

Continuing with reference to FIG. 5, around at least a part of the contour of the flat side of the seal 25 rises perpendicularly to said gasket a wall 27 which, following the shape of said part contour has, by its inner side, a shape that matches the decided shape to match at least with the shape of side 9, FIGS. 3, 3A, 3B, 3C, 3D on B transverse profiles. The wall 27 is intended to cover the outline of said transverse profile B when the connector D is inserted at its end, so that said wall 27 covers or conceals the end of said transverse profile B, preventing the user to see the quality and perfection or imperfection of the cut made to the cited profile B, prior to the assembly. Cutting is performed by the user in order to adapt the size of the enclosure object of the invention in accordance with the user needs. The wall 27 can also wrap the transverse profile contour of said at least part B of the sides 10, 11 or both, shown in FIGS. 3, 3A, 3B, 3C and 3D, in order to cover the cut made by the user when dimensioning the length of said profile B. The provision of the wall 27 corresponds to hide said cutting when the user views the screen of the invention in its normal position of use. In this described embodiment, connector D corresponding to hide the cut sides 9 and 10 FIGS. 3, 3A, and 3B, which are curved when they meet one another. In such an embodiment, it is necessary to assemble a connector D that is, by its right orientation, placed at one end of the transverse profile and a left orientation connector D is needed to perform the same function on the opposite side of said profile. The situation would be different, i.e., need not have left and right orientation for the connector D, in the case of a wall 27 of a connector whose object D is to cover the outline of sides 9, 10 and 11 of a profile B as illustrated in FIG. 3C.

As illustrated in FIGS. 5 and 6, the connector D also includes two openings or recesses 26 that traverse the entire thickness of the gasket 25. Openings are axially aligned with the slots 13, FIGS. 3, 3A, 3B, 3C and 3D of profiles B, when the connectors D are assembled at their ends. The said openings or notches 26 allow the length of the edges of the panels C assembled in said slots 13 to cross gasket 25, as said lengths are greater than the length of the transverse profiles B, then allowing said panels C protrude from both ends of said profile B. The excess length of such panels C, distributed on both sides of the transverse profile B, can penetrate into the longitudinal profiles grooves 6, FIGS. 2, 2A, 2B and 2C, finally being confined in frames formed by the profiles A and B, FIG. 1, without need to do more than square cut operations of said panels C, before assembly.

As illustrated in FIGS. 5 and 6, the connectors D comprise at least two guide pins 34 projecting from the outside of said connector D. Said guide pins may be two or more and which are intended to penetrate and smoothly set in longitudinal profiles of A slots 6, FIGS. 2, 2A, 2B and 2C, so that the connectors D, FIGS. 1, 1A, 5 and 6 may not rotate in a plane perpendicular to the axes of the guide pins 34, when inserted into said slots 6. The movement is also preventable if instead of providing two or more guide pins, a single continuous body is incorporated to unite both guide pins 34 further comprising that the surface of the gasket 25 on the outer side of the connector D as illustrated in FIG. 6 may not be flat as it will have to match the shape of the longitudinal profiles A, side 3, FIGS. 2, 2A, 2B and 2C, when assembled to form the bulkhead of the invention and the shape of said surface depends on the shape of said side.

As illustrated in FIGS. 5 and 6, there is a groove 33 in the connector wall 27. Said groove is technically not essential but has an aesthetic purpose for the said wall 27 to mold to the external contour of the hollow profile section B, as illustrated in FIGS. 3, 3A and 3B. As seen 2Q in these figures, there is a groove shape more or less at the middle of side 9, FIGS. 3, 3A and 3B which is adjusted against the aforesaid wall 27, FIGS. 5 and 6.

Another embodiment of the invention relates to protrusion 31 as shown in Figure Sand FIG. 6. When the connector is inserted on a rail end, protrusion 28 as shown in FIG. 5 holds sleeves 15 as shown in FIG. 3. The said sleeves are not closed circles. There is a channel 14 as shown in FIG. 3 which connects the interior shape of each sleeve 15 to the exterior rail profile member B as shown in FIG. 3. The protrusion 31 as shown in FIG. 5 is designed to complete the circle form of the receiving sleeve once the connector is inserted. The protrusion entering channel 14 as shown in FIG. 3 ensures the fastener will not be misguided which engages channel 14 interior instead of sleeve 15. By comprising channel 14, the exact location of sleeves 15 on the rail profile B is easily achieved because the final PVC extruding forming tools on rail production process actually touch each receiving sleeve interior as the rail is extruded ensuring their shape and location.

According to one embodiment of the invention, the rib profile E, FIGS. 1, 1A, 4 and 4A, is a hollow profile and preferably PVC extrudate or aluminum, in order to be more rigid. Its outer surface may be finished in solid color, translucent or transparent, metallic or pearly appearance, according to the formulation of the extruded compound or may admit laminated coverings or transferred finishing on its outer wall that may be even printed, texturized or both. The rib profile is characterized by having two sides 19 and 20, FIGS. 4 and 4A, any of which may be left to the user's view, in accordance with the preference of the same user, because one will be in view for the side view of the principal side of the joined C panels, FIG. 4A, and the other may be seen by the after-side of said panels together.

In this embodiment being described with reference to FIGS. 4 and 4A, the rib profile E is characterized by comprising the following elements: two grooves 21, at opposite positions, to allow insertion of the edges of panels C, in opposite positions, so that by using one of these profiles, rib E becomes possible that in a single aperture formed by the assembly of profiles A and B, it is possible to introduce more than one panel section C, FIG. 1A. In this opening, there are two or more panels C, FIGS. 1 and 1A, attached by its edges. The advantage that the panel sections C can be designed based on the desired dimensions of the screen object of this invention, while it is possible to use panel sections C which are of multiple size or convenient size to utilize waste without commercial size panels for the manufacture of the partitions object of the invention. The possibility of material change is further achieved by the incorporation of the rib profile E. For example, a rigid panel of wood fiber side of the profile rib and a translucent glass or plastic profile across the rib profile E, resulting in the increased functionality of the enclosure object of this invention.

As shown in FIGS. 4 and 4A, the rib profile E includes a tubular section 20 of a desired shape. The tubular section with which it is achieved that the rib profile E can provide greater resistance to bending when pushed by forces perpendicular to the side or side-view behind panels C, preferably tubular section is to save material in the manufacture of E rib profile. The said rib profile includes two gripping mechanisms arranged on the side panels of the axis of symmetry of rib profile E. Each of these mechanisms comprises a spring 22 and a safe 23, components that facilitate and ensure firm assembly and to secure panels C, FIGS. 1, 1A and 4A, under which, when measuring parallel to the axis of symmetry of rib profile E, the springs 22 are closer to tubular section 24 than the thickness of panels C. Said fact forces the aforementioned springs, deforming in parallel to said axis of symmetry when said panels C are inserted as shown in FIG. 4A. When panels C are inserted, there is a force exerted by the material from which is constructed the rib profile E. The strength of pressing the panels C against the tubular section 24, and said force creates a torque on panel C, when fitted on one side of the profile E according to FIG. 4A, under which, the reaction force or strength of pressing offered by the tubular section 24 is not aligned with the point of application of the force exerted by the spring 22. When reaching the bottom of the groove 21, said torque cannot rotate the panel C in relation to the rib profile E, under which said panel C is subjected, because there is a safe 23. Safe 23 certainly provides a reaction force that cancels the aforementioned torque. FIG. 4A shows that the opening between the spring 22 and the tubular section 24 is larger than the thickness of panel C inserted between the said elements, said opening facilitating insertion of panel C between said two structures. In addition, it is appreciated that in order to facilitate panel C edge to reach groove 21 bottom, and accommodate the insertion between the tubular section 24 and the safe 23, the said safe is arranged so that the distance between it and the said tubular section, is decreasing and approaches the thickness of panel C as it approaches the bottom of the groove 21.

In one embodiment of the invention, the partition object of this invention further comprises one or more guide rails F, FIGS. 1, 1A, and 7, which is optional for the user to add or disregard on the top or bottom of the screen object of the invention. These guiding profiles are preferably PVC extrudates and engage the transverse hollow profiles B, FIGS. 1, 1A, 3, 3A and 3B, which are placed at the ends of the longitudinal profiles A, FIGS. 1 and 1A. When such assemblies are built, the top and bottom ends of the screen object of the invention exhibit projections which can slide transversely on rails (not shown) both above and below. In the preferred embodiment of the invention, an option for the screen object of the invention which can be operated as a sliding door, wherein said guide rails F are supported directly by the sleeve receptor 15, FIGS. 3, 3A, and 3, due to the thickened wall 35, intended to be introduced axially into the sleeve receptor 15, FIGS. 3, 3A, and 3B, so that the guide profile F remains engaged to the structure formed by the elements 13, 14 and 15, FIGS. 3, 3A, and 3B. This is located either on the side 10, FIGS. 3, 3A, and 3B, or in side 11, FIGS. 3, 3A, and 3B, on one of the cross section B, which are assembled perpendicularly to the ends of profiles A, so that the prolongation or extension 37 of said guide rail profile F extends beyond the boundary of the perimeter of the said section or full cross section B. Therefore, the said extensions 37 protrude beyond the overall length of the longitudinal profiles A when the guide rails F are positioned. The projecting extensions which allow the partition of the invention can be guided in parallel rails (not shown) to the transverse profiles B in which the said partition is moved. Said guide section F can not be shifted and dislodged through the tip of the profile B because its axial movement is limited by the existence of the clamping element G which prevent the passage. The extension 37, is connected to the bulge 35 by means of a link 36 which may or may not be required or may have a different shape, depending on the configuration having the structure of the components 13, 14 and 15, FIGS. 3, 3A, and 3B, incorporated into the transverse profile B. The guide profile F also comprises two projections 38, FIG. 7, away from the axis of symmetry of the extension 37 so that they can not be inserted between the two walls of the groove 13, FIGS. 3, 3A, and 3B, and remain outside the outer circumference of the hollow profile section B. The thickness of said projections 38 projecting beyond the length of the longitudinal profile A when F profile is coupled to one of the hollow profiles which are positioned transversely to A. Thus, another object of the invention bulkhead is if placed standing on the profile F, previously assembled, and the extension 37 of that profile is housed in a groove that, for example, be in the floor or in a framework within which it is intended to move the partition of the invention like a sliding door or enclosure, and said groove is barely wider than the thickness of extension 37 as well as deeper than said extension protrusion length, then the two projections 38 rest on top of the sidewalls of said ground groove, separating the lower end of both the lower longitudinal hollow profiles from the said groove of the floor. Both projections 38 being constituted in bearings on which the sliding takes the place to form the enclosure object of the invention.

While the present invention has been described with particular reference to certain preferred embodiments, however it should be understood that these are only illustrations of the inventive principle and should in no way be interpreted as limiting, since the screen can be realized in a number of ways, dimensions and materials, as appropriate. Thus, different configurations may be used profiles and connectors according to specific conditions and requirements that arise in a given situation, provided that such profiles and connectors have the technical characteristics described here and allow them to engage in the inventive principles already described.

Therefore, it should be understood that the present invention has been described only with particular reference to a number of preferred embodiments, but which nevertheless is clear to those skilled in the art that there is a wide range of possible changes, modifications and alterations, all within the inventive spirit thereof, and is intended, therefore, that the scope thereof being limited only by the scope of the same appended claims.

The invention claimed is:

1. A movable, buildable, separable, mountable, demountable, or collapsible divider, screen, partition or panel assembly comprising:

a frame construction comprising a pair of longitudinal profiles and top and bottom transverse profiles to define a quadrilateral configuration; each of said pair of longitudinal and said top and bottom transverse profiles comprising a hollow extruded profile comprising at least one inner groove which runs along one side in a longitudinal direction of each of said pair of longitudinal profiles and said top and bottom transverse profiles;

one or more panels of sheet material are confined within said frame construction along said at least one inner groove, wherein the pair of longitudinal profiles are attached to the said top and bottom transverse profiles through a plurality of aligned connectors and are fastened by fasteners;

said plurality of aligned connectors configured for a gasket function allowing protrusions and holes to align, cover defects, and reinforce joints to ensure fastener assembly; a connector of said plurality of connectors prevents direct contact between each of said pair of longitudinal profiles and said top and bottom transverse profiles; said defects selected from cutting defects in one or both ends of said top and bottom profiles;

said plurality of aligned connectors configured for an accessory function covering ends of said top and bottom transverse profile to hide defects by hand cutting tools when said top and bottom transverse profiles are cut to final length;

said plurality of aligned connectors configured for a structural function to prevent each of said pair of longitudinal profiles and said top and bottom transverse profiles from deforming during fastener insertion;

said plurality of aligned connectors configured for a guide profile function preventing fasteners from following a non-aligned track as said plurality of aligned connectors engage said top and bottom transverse profiles;

said plurality of aligned connectors comprising a defined protrusion or protrusions inserted to one inner groove of each of said pair of longitudinal profiles aligning said plurality of aligned connectors to each of said pair of longitudinal profiles and said top and bottom transverse profiles;

wherein said defined protrusion or protrusions penetrate said top and bottom transverse profiles for coupling to said pair of longitudinal profiles and said top and bottom transverse profiles; wherein said defined protrusion or protrusions are disposed on opposite sides of a gasket element to provide an aligned longitudinal/transverse profile assembly;

wherein said pair of longitudinal profiles comprise at least one additional second longitudinal groove in the form of a U-shape located on an opposite side to an inner groove, said at least one additional second longitudinal groove hides fastening element heads which are fixed to the said top and bottom transverse profiles through each of said pair of longitudinal profiles.

2. A movable, buildable, separable, demountable, or collapsible divider, screen, partition or panel according to claim 1, wherein the top and bottom transverse profiles comprise a second longitudinal groove, said second longitudinal groove comprising a groove, located on an opposite side to the at least one inner groove.

3. A movable, buildable, separable, mountable, demountable, or collapsible divider, screen, partition or panel according to claim 1, wherein both the pair of longitudinal profiles and the top and bottom transverse profiles further comprise filling structural elements for resistance to bending, the filling structural elements selected from a group consisting of metal pipes, wood, plastic, and combinations thereof.

4. A movable, buildable, separable, mountable, demountable, or collapsible divider, screen, partition or panel according to claim 1, wherein both the pair of longitudinal profiles and the top and bottom transverse profiles, further comprises filler strips of wood or other material so that the screw connectors on an outer surface of the profiles, the and threads of bolts are resistant substrates to be anchored inside.

5. A movable, buildable, separable, mountable, demountable, or collapsible divider, screen, partition or panel according to claim 1, further comprising reinforcement elements separating said pair of longitudinal frame profiles and said top and bottom transverse profiles mounted perpendicular to a longitudinal axis.

6. A movable, buildable, separable, mountable, demountable, or collapsible divider, screen, partition or panel according to claim 1, wherein the top and bottom transverse profiles further comprise at least one sleeve or a plurality of sleeves receiving a clamping or fastening element which joins together with each of said pair of longitudinal profiles and said top and bottom transverse profiles.

7. A movable, buildable, separable, mountable, demountable, or collapsible divider, screen, partition or panel according to claim 1, wherein the plurality of aligned connectors further comprise, on an inner side of said plurality of aligned connectors, at least one engaging structure or a plurality of engaging structures to surround and press at least part of a perimeter of a sleeve receptor when each connector of said plurality of connectors is inserted into a transverse profile end.

8. A movable, buildable, separable, mountable, demountable, or collapsible divider, screen, partition or panel according to claim 7, further comprising two or more engaging structures used to surround the sleeve receptor are joined by solid walls forming a bend resistant and rigid two or more engaging structures.

9. A movable, buildable, separable, mountable, demountable, or collapsible divider, screen, partition or panel according to claim 7, wherein the plurality of aligned connectors that prevent direct contact between the pair of longitudinal profiles and top and bottom transverse profiles further comprises at least one hole or a plurality of holes aligned with a sleeve receptor receiving a fastening element which is joined together with said pair of longitudinal profiles and top and bottom transverse profiles.

10. A movable, buildable, separable, mountable, demountable, or collapsible divider, screen, partition or panel according to claim 7, wherein the plurality of aligned connectors that prevent direct contact between the pair of longitudinal profiles and top and bottom transverse profiles further comprises two recesses that are aligned, one recess aligned with said at least one inner grove and another recess aligned with a second groove on the top and bottom transverse profiles when said plurality of aligned connectors are inserted into said top and bottom transverse profiles.

11. A movable, buildable, separable, mountable, demountable, or collapsible divider, screen, partition or panel according to claim 7, wherein the plurality of aligned connectors that prevent direct contact between the pair of longitudinal profiles and top and bottom transverse profiles further comprises, on an outer side, at least one guide pin projecting from said outer side of the plurality of aligned connectors configured to penetrate and fit into a profile slot of the pair of longitudinal profiles when joining.

12. A movable, buildable, separable, mountable, demountable, or collapsible divider, screen, partition or panel according to claim 7, wherein the plurality of aligned connectors that prevent direct contact between the pair of longitudinal profiles and top and bottom transverse profiles further comprises, on an inner side, at least one projection or a plurality of projections projecting from an inner surface of the plurality of aligned connectors and which penetrates into a sleeve receptor with the top and bottom transverse profiles and aligns the plurality of aligned connectors with said top and bottom transverse profiles during an insertion operation.

13. A movable, buildable, separable, mountable, demountable, or collapsible divider, screen, partition or panel according to claim 7, wherein the plurality of aligned connectors that prevent direct contact between the pair of longitudinal profiles and top and bottom transverse profiles further comprises a perimeter wall extending from a perimeter such that said plurality of aligned connectors hide a part where said plurality of aligned connectors are attached to a transverse direction when said plurality of aligned connectors are inserted into the pair of longitudinal profiles and top and bottom of transverse profiles.

14. A movable, buildable, separable, mountable, demountable, or collapsible divider, screen, partition or panel according to claim 1, further comprising at least two panels of sheet material joined together via a rib profile which prevents direct contact between said at least two panels, a frame construction comprising at least two longitudinal and at least two transverse profiles, said at least two longitudinal profiles and said at least two transverse profiles comprising a hollow extruded profile which include at least one inner groove which runs along one side in a longitudinal direction, each of said at least two longitudinal profiles and said at least two transverse profiles confining the at least two panels.

15. A movable, buildable, separable, mountable, demountable, or collapsible divider, screen, partition or panel according to claim 14, wherein the rib profile that prevents direct contact between the at least two panels comprises at least one tubular section.

16. A movable, buildable, separable, demountable, and collapsible divider, screen, partition or panel according to claim 14, wherein the rib profile that prevents direct contact between the at least two panels, further comprises a spring means to hold and secure the edges of the at least two panels together.

17. A movable, buildable, separable, mountable, demountable, or collapsible divider, screen, partition or panel according to claim 1, further comprising a guide profile having one end introduced into a second groove of the top and bottom transverse profiles and another end inserted into a slot on a rail for guiding movement of a partition along a longitudinal axis of said top and bottom transverse profiles.

18. A movable, buildable, separable, mountable, demountable, or collapsible divider, screen, partition or panel according to claim 17, wherein the guide profile further comprises one end which remains outside of the second groove of the top and bottom transverse profiles, and a means for the sliding of a screen when the screen rests and runs on a rail on a floor.

19. A movable, buildable, separable, mountable, demountable, or collapsible divider, screen, partition or panel assembly comprising:

a frame construction comprising a pair of longitudinal profiles and top and bottom transverse profiles to define a quadrilateral configuration; each of said pair of longitudinal and said top and bottom transverse profiles comprising a hollow extruded profile comprising at least one inner groove which runs along one side in a longitudinal direction of each of said pair of longitudinal profiles and said top and bottom transverse profiles;

one or more panels of sheet material are confined within said frame construction along said at least one inner groove, wherein the pair of longitudinal profiles are attached to the said top and bottom transverse profiles through a plurality of aligned connectors and are fastened by fasteners;

said plurality of aligned connectors configured for a gasket function allowing protrusions and holes to align, cover defects, and reinforce joints to ensure fastener assembly; a connector of said plurality of connectors prevents direct contact between each of said pair of longitudinal profiles and said top and bottom transverse profiles; said defects selected from cutting defects in one or both ends of said top and bottom profiles;

said plurality of aligned connectors configured for an accessory function covering ends of said top and bottom transverse profile to hide defects by hand cutting tools when said top and bottom transverse profiles are cut to final length;

said plurality of aligned connectors configured for a structural function to prevent each of said pair of longitudinal profiles and said top and bottom transverse profiles from deforming during fastener insertion;

said plurality of aligned connectors configured for a guide profile function preventing fasteners from following a non-aligned track as said plurality of aligned connectors engage said top and bottom transverse profiles;

said plurality of aligned connectors comprising a defined protrusion or protrusions and inserted to one inner groove of each of said pair of longitudinal profiles aligning said plurality of aligned connectors to each of said pair of longitudinal profiles and said top and bottom transverse profiles;

wherein said defined protrusion or protrusions penetrate said top and bottom transverse profiles for coupling to said pair of longitudinal profiles and said top and bottom transverse profiles; wherein said defined protrusion or protrusions are disposed on opposite sides of a gasket element to provide an aligned longitudinal/transverse profile assembly;

wherein said pair of longitudinal profiles comprise at least one additional second longitudinal groove in the form of a U-shape located on an opposite side to an inner groove, said at least one additional second longitudinal groove hides fastening element heads which are fixed to the said top and bottom transverse profiles through each of said pair of longitudinal profiles;

an accessory member which receives a clamping or fastening element joined together with said pair of longitudinal profiles and the top and bottom transverse profiles;

an adjustment member provided on an opposing side edge;

a rib profile member comprising grooves in opposing positions to allow insertion of panels; said rib profile member comprising an at least two grip configuration arranged on side panels to facilitate and secure assembly of panels;

wherein the pair of longitudinal profiles comprise at least one additional second longitudinal groove in the form of a U-shape located on an opposite side to the at least one inner groove, said at least one additional second longitudinal groove hides fastening element heads which are fixed to said top and bottom transverse profiles through said pair of longitudinal profiles.

20. A movable, buildable, separable, mountable, demountable, or collapsible divider, screen, partition or panel assembly comprising:

a frame construction comprising a pair of longitudinal profiles and top and bottom transverse profiles to define a quadrilateral configuration; each of said pair of longitudinal and said top and bottom transverse profiles comprising a hollow extruded profile comprising at least one inner groove which runs along one side in a longitudinal direction of each of said pair of longitudinal profiles and said top and bottom transverse profiles;

one or more panels of sheet material are confined within said frame construction along said at least one inner groove, wherein the pair of longitudinal profiles are attached to the said top and bottom transverse profiles through a plurality of aligned connectors and are fastened by fasteners;

said plurality of aligned connectors configured for a gasket function allowing protrusions and holes to align, cover defects, and reinforce joints to ensure fastener assembly; a connector of said plurality of connectors prevents direct contact between each of said pair of longitudinal profiles and said top and bottom transverse profiles; said defects selected from cutting defects in one or both ends of said top and bottom profiles;

said plurality of aligned connectors configured for an accessory function covering ends of said top and bottom transverse profile to hide defects by hand cutting tools when said top and bottom transverse profiles are cut to final length;

said plurality of aligned connectors configured for a structural function to prevent each of said pair of longitudinal profiles and said top and bottom transverse profiles from deforming during fastener insertion;

said plurality of aligned connectors configured for a guide profile function preventing fasteners from following an incorrect track as said plurality of aligned connectors engage said top and bottom transverse profiles;

said plurality of aligned connectors comprising a defined protrusion or protrusions inserted to one inner groove of each of said pair of longitudinal profiles aligning said plurality of aligned connectors to each of said pair of longitudinal profiles and said top and bottom transverse profiles;

wherein said defined protrusion or protrusions penetrate said top and bottom transverse profiles for coupling to said pair of longitudinal profiles and said top and bottom transverse profiles; wherein said defined protrusion or protrusions are disposed on opposite sides of a gasket element to provide an aligned longitudinal/transverse profile assembly;

wherein said pair of longitudinal profiles comprise at least one additional second longitudinal groove in the form of a U-shape located on an opposite side to an inner groove, said at least one additional second longitudinal groove hides fastening element heads which are fixed to the said top and bottom transverse profiles through each of said pair of longitudinal profiles;

the method comprising the steps of:

a) determining a location for the frame construction and measuring dimensions of an opening;

b) cutting the top and bottom transverse profiles, the pair of longitudinal profiles and panel materials to a desired dimension;

c) inserting reinforcement elements or a connector of said plurality of aligned connectors on an edge of the top and bottom transverse profiles such that the defined protrusion or protrusions face inward;

d) positioning a connector of said plurality of aligned connectors with a fastener's threads receiving sleeves disposed on the top and bottom transverse profiles;

e) providing a connector of said plurality of aligned connectors covering an outer perimeter of an end of the top and bottom transverse profiles to hide defects resulting from use of tools;

f) cutting the top and bottom transverse profiles to final length;

g) providing a connector of said plurality of aligned connectors comprising protrusions facing outward the top and bottom transverse profiles;

h) providing protrusions to engage the U-shaped groove located along the pair of longitudinal profiles to provide alignment between the pair of longitudinal profiles and the top and bottom transverse profiles before fasteners are inserted;

i) passing fasteners through holes of a connector; a connector of said plurality of aligned connectors further comprising protrusions facing inward the top and bottom transverse profiles such that the protrusions engages the top and bottom transverse profiles fastener's threads receiving sleeves;

j) verifying fastener assembly; said protrusions preventing fasteners from following a non-aligned path during assembly;

k) joining the pair of longitudinal profiles and the top and bottom transverse profiles together with the reinforcement elements or plurality of aligned connectors, and cutting covering elements or said plurality of aligned connectors in between and fastening the pair of longitudinal profiles and the top and bottom transverse profiles;

l) inserting a pre-cut panel into the at least one inner groove and the at least one additional second longitudinal groove;

m) disposing the pre-cut panel along a groove of the pair of longitudinal profiles and the top and bottom transverse profile such that each of the pair of longitudinal profiles and the top and bottom transverse profiles surrounds the pre-cut panel;

n) inserting the plurality of aligned connectors to the top and bottom transverse profiles adjacent to the pair of longitudinal profiles; said plurality of aligned connectors configured for gasket function; said plurality of aligned connectors comprising protrusions; said plurality of aligned connectors configured to cover ends of the top and bottom transverse profiles to hide defects caused by tools when the top and bottom transverse profiles are cut to final length;

o) preventing the pair of longitudinal profiles and the top and bottom transverse profiles from deforming during fastener insertion; preventing fasteners from following a non-aligned track as the fasteners engage said top and bottom transverse profiles; and providing assembly and coupling between the top and bottom transverse profiles, the plurality of aligned connectors, and said pair of longitudinal profiles by fasteners.

* * * * *